US005315359A

United States Patent [19]

Nishikawa

[11] Patent Number: 5,315,359

[45] Date of Patent: May 24, 1994

[54] HEAT ROLL FIXING UNIT

[75] Inventor: Tomoyuki Nishikawa, Matsudo, Japan

[73] Assignee: Asahi Kogaku Kogyo Kabushiki Kaisha, Tokyo, Japan

[21] Appl. No.: 927,727

[22] Filed: Aug. 11, 1992

Related U.S. Application Data

[63] Continuation of Ser. No. 664,672, Mar. 5, 1991, abandoned.

[30] Foreign Application Priority Data

Mar. 6, 1990 [JP] Japan ..... 2-54164

[51] Int. Cl.[5] ..... G03G 21/00

[52] U.S. Cl. ..... 355/315; 355/295; 271/308; 271/311

[58] Field of Search ..... 355/283, 285, 295, 315; 271/273, 308, 311

[56] References Cited

U.S. PATENT DOCUMENTS

| | | | |
|---|---|---|---|
| 4,218,499 | 9/1980 | Shinohara et al. | 427/444 |
| 4,265,198 | 5/1981 | Shinohara et al. | 118/695 |
| 4,297,716 | 10/1981 | Hirayama et al. | 346/153.1 |
| 4,384,781 | 5/1983 | Takada | 355/290 |
| 4,475,804 | 10/1984 | Kanno et al. | 355/295 |
| 4,541,708 | 9/1985 | Shigenobu | 355/285 X |

FOREIGN PATENT DOCUMENTS

| | | | |
|---|---|---|---|
| 0278237 | 8/1988 | European Pat. Off. . | |
| 0328072 | 8/1989 | European Pat. Off. . | |
| 2734314 | 2/1978 | Fed. Rep. of Germany . | |
| 2734393 | 2/1978 | Fed. Rep. of Germany . | |
| 3842745 | 7/1989 | Fed. Rep. of Germany . | |
| 57-5073 | 1/1982 | Japan . | |
| 0155071 | 6/1988 | Japan | 355/315 |
| 1163790 | 6/1989 | Japan . | |

OTHER PUBLICATIONS

United Kingdom Search Report.

English Abstract to Japanese Patent No. 57-5073.

*Primary Examiner*—Michael L. Gellner

*Assistant Examiner*—P. Stanzione

*Attorney, Agent, or Firm*—Sandler, Greenblum & Bernstein

[57] ABSTRACT

In a heat roll fixing unit, adapted to be positioned in a printer employing an electrophotographic system for forming an image on a continuous-sheet to be fed in the printer, a pair of rollers is provided that are arranged to be brought into and out of contact with each other for pressurizing the continuous-sheet to fix the image thereon. One of the pair of rollers is a heat roller that is heated by a predetermined heating member. The heat roll fixing unit further comprises a sheet separation mechanism located at the downstream side of the pair of rollers and arranged to be operable when the pair of rollers is brought out of contact with each other for separating the continuous-sheet from the heat roller. Thus, the continuous-sheet can be prevented from remaining in contact with the roller after the fixing operation in the heat roll fixing unit. It thus becomes possible to avoid jamming of the continuous-sheet.

39 Claims, 9 Drawing Sheets

HEAT ROLL FIXING UNIT

This application is a continuation of application Ser. No. 07/664,672, filed Mar. 5, 1991, now abandoned.

BACKGROUND OF THE INVENTION

The present invention relates to a heat roll fixing unit for fixing toner on a surface of a recording sheet employed in an image formation device, such as a printer, for forming a visible image by a so-called electrophotographic system. More particularly, the present invention relates to a structure of the heat roll fixing unit in which it is possible to prevent the recording sheet from being caught around a roller and thus being poorly fed through the printer.

Conventionally, there has been known a so-called electrophotographic system, wherein a latent image is formed by exposing a photoreceptor on a surface of a photoconductive drum, adhering toner to the latent image to change the latent image to a visible toner image, and transferring the toner image to a recording sheet and fixing the image to the recording sheet at a fixing unit.

An example of an image formation device using this electrophotographic system is an electrophotographic printer for forming an image on a continuous-form recording sheet similar to that used in a conventional line printer and the like.

The continuous-form recording sheet, similar to that used in the line printer, is a folded sheet provided with a perforated tear line, referred to as a fan-folded continuous-form sheet (hereinafter, simply referred to as a continuous-sheet), and the folded portion thereof can be easily torn off along the perforated tear line.

Usually, in a image formation device using the conventional electrophotographic system, such as a copy machine and the like, a so-called heat roll fixing method is often used as a method of fixing toner, having been transferred on the recording sheet in accordance with the latent image, by which the recording sheet is pressed against a heated roller and toner is heated and fusedly adhered to the recording sheet by the heat applied to the roller.

To effect the heat roll fixing, a fixing roller pair is composed of the heat roller heated to high temperatures and a press roller, which are disposed in parallel to each other with the recording sheet held therebetween to cause the recording sheet to be pressed against the heat roller for heating. The heat roll fixing method is advantageous in that the fixing can be carried out at high speed with a high thermal efficiency.

When the heat roll fixing method is employed in the electrophotographic printer using the above continuous sheet as the recording sheet, a drawback arises in that when the continuous-sheet is held between the heat roller and the press roller when printing is not executed, the same portion of the recording sheet is burned or blistered by the heat applied from the heat roller. To overcome this drawback, a structure of the rollers, in which one roller can be retracted to prevent the recording sheet from coming into contact with a heat roller when printing operation is not executed, has been proposed in, for example, Japanese Patent Provisional Publication No. HEI 1-163790.

Nevertheless, even if the heat roller is, for example, rockably retracted when printing is not executed, a problem arises in that the continuous-sheet may be bent to a direction in which the heat roller is retracted and may be continuously in contact with the heat roller with the result that such drawbacks as burning and blistering occurring. Further, a drawback also arises in that the continuous-sheet is adhered to the heat roller by the depositing force of the toner and cannot be separated, therefrom and thus the continuous-sheet may be caught around the roller and cannot be fed, i.e., a so-called jam may occur.

SUMMARY OF THE INVENTION

It is therefore an object of the present invention to provide an improved heat roll fixing unit, including a pair of rollers arranged to be brought into and out of contact with each other, arranged in such a manner that the continuous-sheet is completely separated from the rollers when the rollers are brought out of contact from each other.

For this purpose, according to the present invention, there is provided a heat roll fixing unit, adapted to be positioned in a printer employing an electrophotographic system for forming an image on a continuous-sheet to be fed in the printer, comprising a pair of rollers arranged to be brought into and out of contact with each other for pressurizing the continuous-sheet to fix the image thereon, with one of the pair of rollers being a heat roller to be heated up by means of a predetermined heating member.

The heat roll fixing unit, according to the present invention, comprises a sheet separation mechanism located at the downstream side of the pair of rollers and arranged to be operable in case that the pair of rollers are brought out of contact with each other for separating the continuous-sheet from the heat roller.

DESCRIPTION OF THE ACCOMPANYING DRAWINGS

DESCRIPTION OF THE EMBODIMENTS

Figure 1:
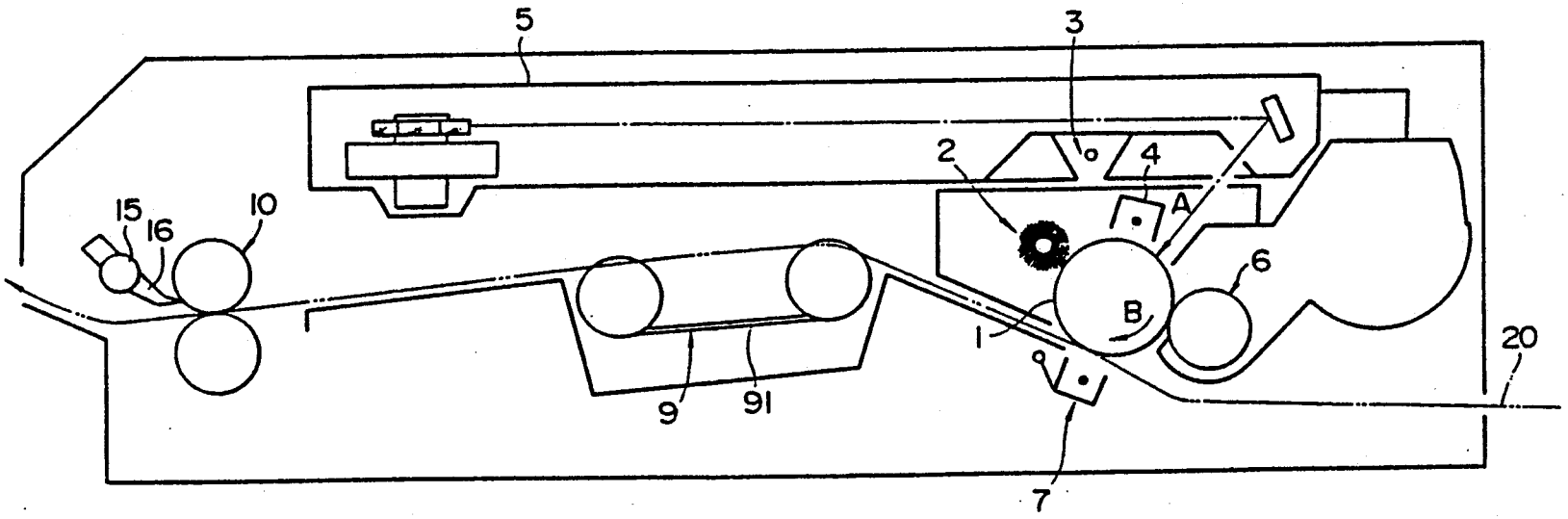
FIG. 1 shows a side view of an electrophotographic printer employing a heat roll fixing unit according to the present invention.

FIG. 1 shows a laser beam printer, using a continuous-form fan-folded sheet as a recording sheet, by which character information inputted from a computer and the like, not shown, are printed on the continuous-sheet 20 by a so-called electrophotographic system.

Figure 2:
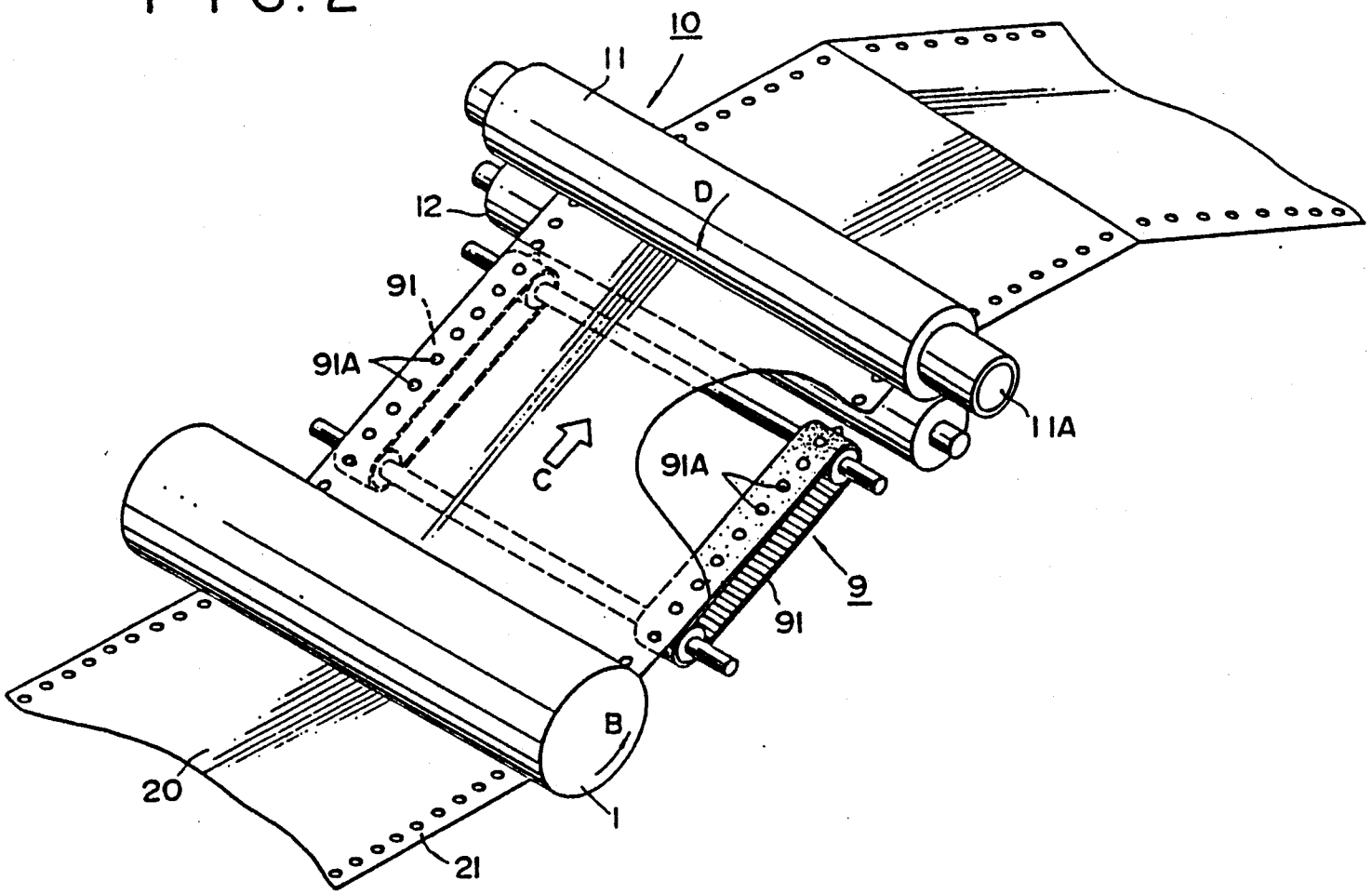
FIG. 2 shows a perspective view of a positional relationship among a photoconductive drum, a tractor, and the heat roll fixing unit, respectively employed in the printer shown in FIG. 1.

A toner cleaning unit 2, a discharging unit 3, a charging unit 4, a scanning optical system 5 for introducing a laser beam to a photoconductive drum 1 as indicated by an arrow "A", a development unit 6, and a transfer unit 7 are disposed, respectively, around the photoconductive drum 1 in the rotating direction thereof indicated by an arrow "B". Further, a fixing unit 10 is disposed at the downstream side of the photoconductive drum 1, and a tractor 9 through which the continuous-sheet 20 is fed toward the fixing unit 10 is disposed as shown in FIG. 1. The tractor 9 includes a pair of tractor belts 91, 91 each having a plurality of projections 91A arranged to be fitted into a plurality of sprocket holes 21 provided on both side edges of the continuous-sheet 20, as shown in FIG. 2. The continuous-sheet 20 having been fed through the photoconductive drum 1 is fed by the tractor 9 as indicated by an arrow "C".

In this above-described laser beam printer, a circumferential surface of the photoconductive drum 1 is charged at the charging unit 4, and as the photoconductive drum 1 is rotated in the "B" direction, the surface thereof is scanned by the laser beam from the scanning optical system 5, having been modulated by image information to be developed, to form an electrostatic latent image. Toner is adhered to the latent image at the development unit 6 to form a visible image corresponding to the latent image, and the toner image is transferred onto the continuous-form sheet 20 at the transfer unit 7 and fixed at the fixing unit 10.

As shown in FIG. 2, the fixing unit 10 comprises a pair of rollers, respectively supported by shafts, not shown, comprising a heat roller 11 to be heated up to predetermined temperature by means of a heating element 11A, such as a halogen lamp contained within a cylindrical body thereof, and a press roller 12 arranged to be brought into and out of contact the heat roller 11. The lower press roller 12 is a rubber lined roller whose circumferential surface is lined by silicon rubber or the like having a predetermined hardness and a predetermined thickness and pressed against the heat roller 11 by a not shown spring. The heat roller 11 is arranged to be rotated by a not shown drive source, such as a motor, along a direction indicated by an arrow "D" and the press roller 12 is arranged to be rotated with the heat roller 11 by means of a not shown transmission mechanism. In a contacted state, a predetermined pressure force is generated between the pair of rollers and the continuous-from sheet 20 which is fed along the "C" direction is pressed thereby.

With referring to drawings of FIGS. 3 through 7, an arrangement and an operation of the heat roll fixing unit according to the present invention will be described hereinafter.

Figure 3:
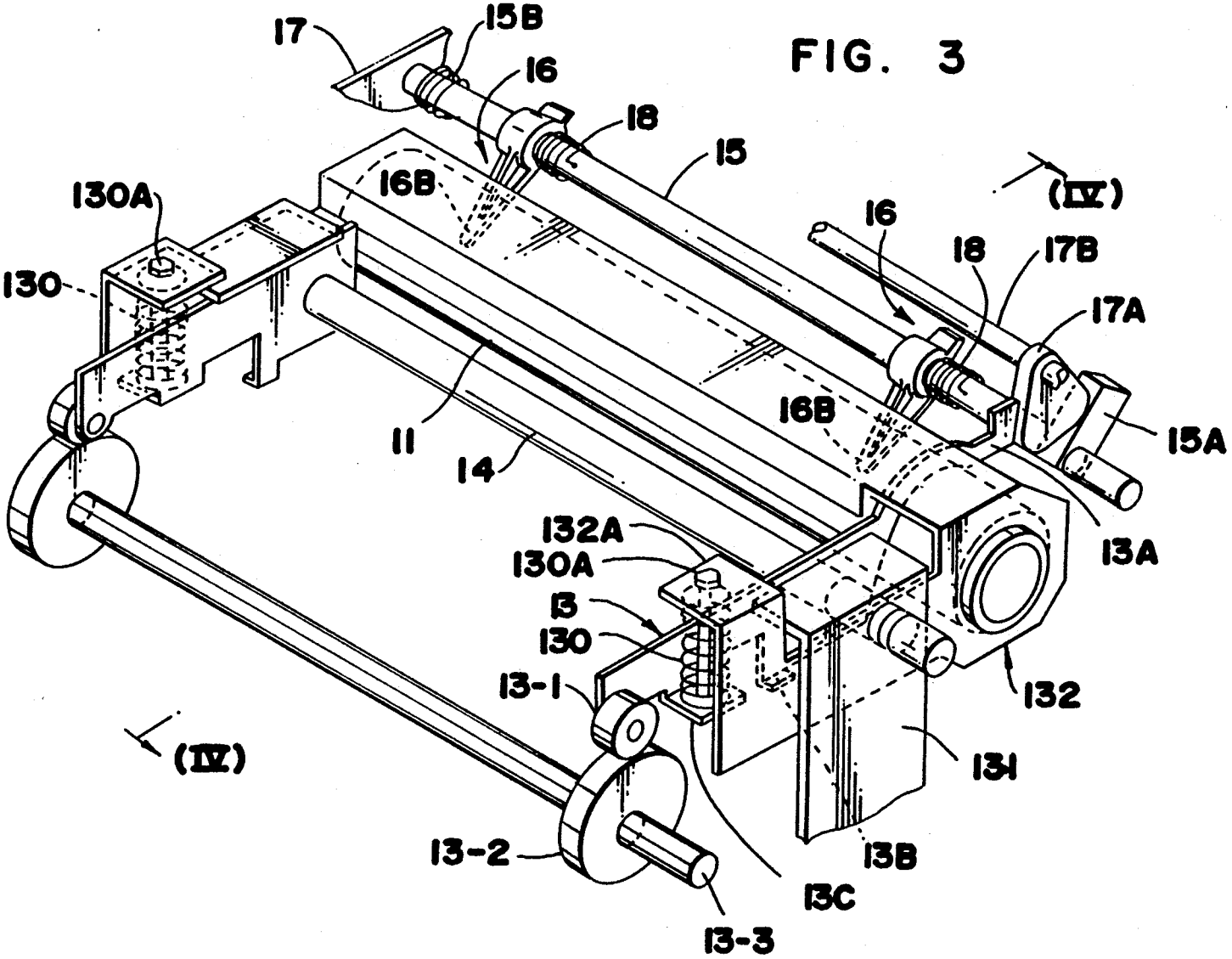
FIG. 3 shows a perspective view for illustrating an operation of a driving mechanism of a jam prevention piece to be attached to the heat roll fixing unit shown in FIG. 2.
Figure 3A:
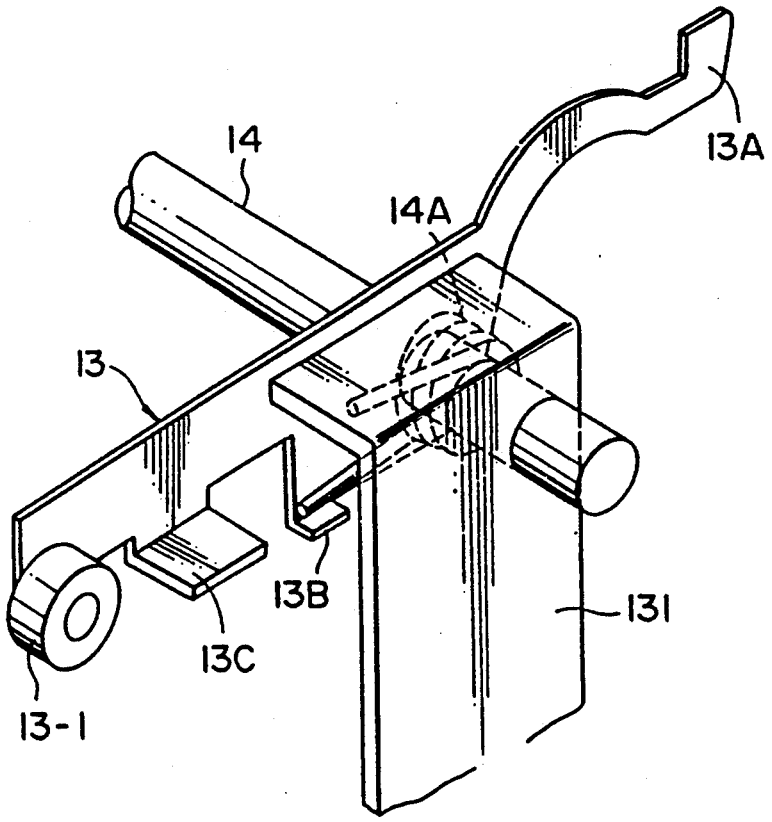
FIG. 3A shows a perspective view of a lever biasing mechanism including a torsion spring which is employed in the heat roll fixing unit shown in FIG. 3.
Figure 4:
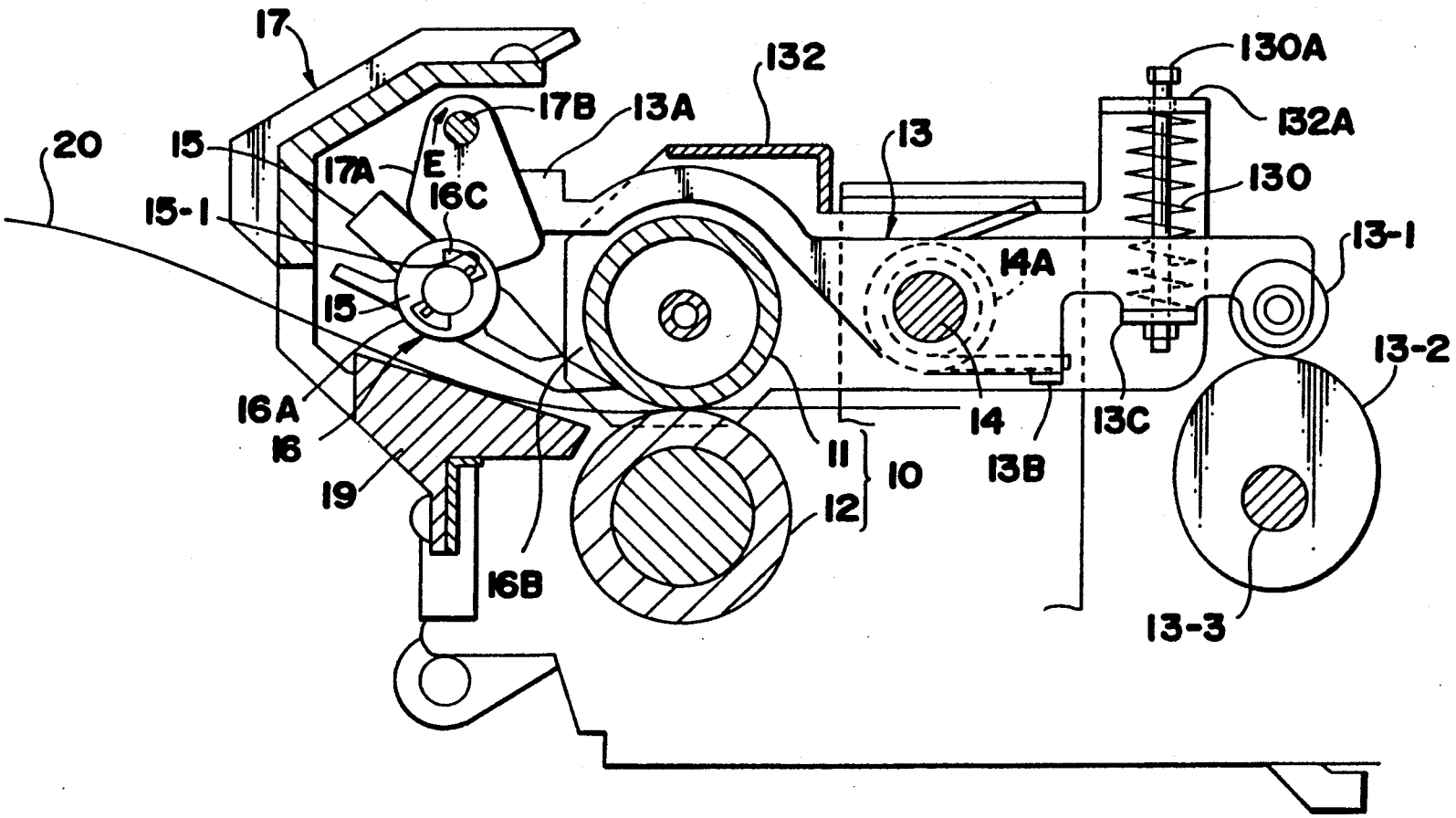
FIG. 4 shows a side view, sectioned along the line (IV)—(IV) of FIG. 3, of the heat roll fixing unit in an operating state.

FIGS. 3 and 3A are perspective views of the schematic arrangement of a heat roll fixing unit according to the present invention and a lever rocking mechanism to be employed thereto, and FIG. 4 is a side view of the heat roll fixing unit in an operating state. The heat roller 11 is accommodated within a heat roll holder 132 which is supported by a lever 13 arranged to be swingingly rocked in upward and downward direction in accordance with movement of a cam follower 13-1. The cam follower 13-1 is driven to be vertically moved as a cam 13-2, which is connected to a not shown drive source through a shaft 13-3, is driven to be rotated.

The lever 13 is rockably mounted, substantially at the center in the lengthwise direction thereof, to a chassis 131 by means of a pin 14, and has the cam follower 13-1 provided at the extreme end of one side thereof. The lever 13 is downwardly biased by means of a pair of torsion springs 14A, 14A through a contact portion 13B provided on the lever 13, so that the cam 13-2 and the cam follower 13-1 are brought into contact with each other. As shown in FIG. 4, the continuous-sheet 20 is fed from the cam follower 13-1 side toward the fixing rollers 11, 12 side. An operating portion 13A is formed at the opposite side of the cam follower 13-1 about the pin 14 to rotate a shaft 15 described later. A pair of springs 130, 130 are respectively interposed between a spring receiving portion 13C provided on the lever 13 and a spring receiver 132A provided on the heat roll holder 132. Further, a pair of rock regulation screws 130A, 130A are provided within the springs 130, 130, so that an angle formed by the lever 13 and the heat roll holder 132 is regulated so as to be less than a predetermined value. As the cam 13-2 is rotated, the springs 130, 130 are compressed and the heat roll holder 132 is downwardly rocked about the pin 14, finally, the rollers 11, 12 are contacted with each other. Further, the heat roll holder 132 is not further moved when pressure force generated between the rollers becomes a predetermined value determined by the springs 130, 130, and the lever 13 is only rocked about the pin 14 and a spacer piece 17A attached to the operating portion 13A is pushed. The spacer piece 17A is arranged to be rocked in a direction indicated by an arrow "E" about a shaft 17B when it is pressed by the operating portion 13A.

Figure 6:
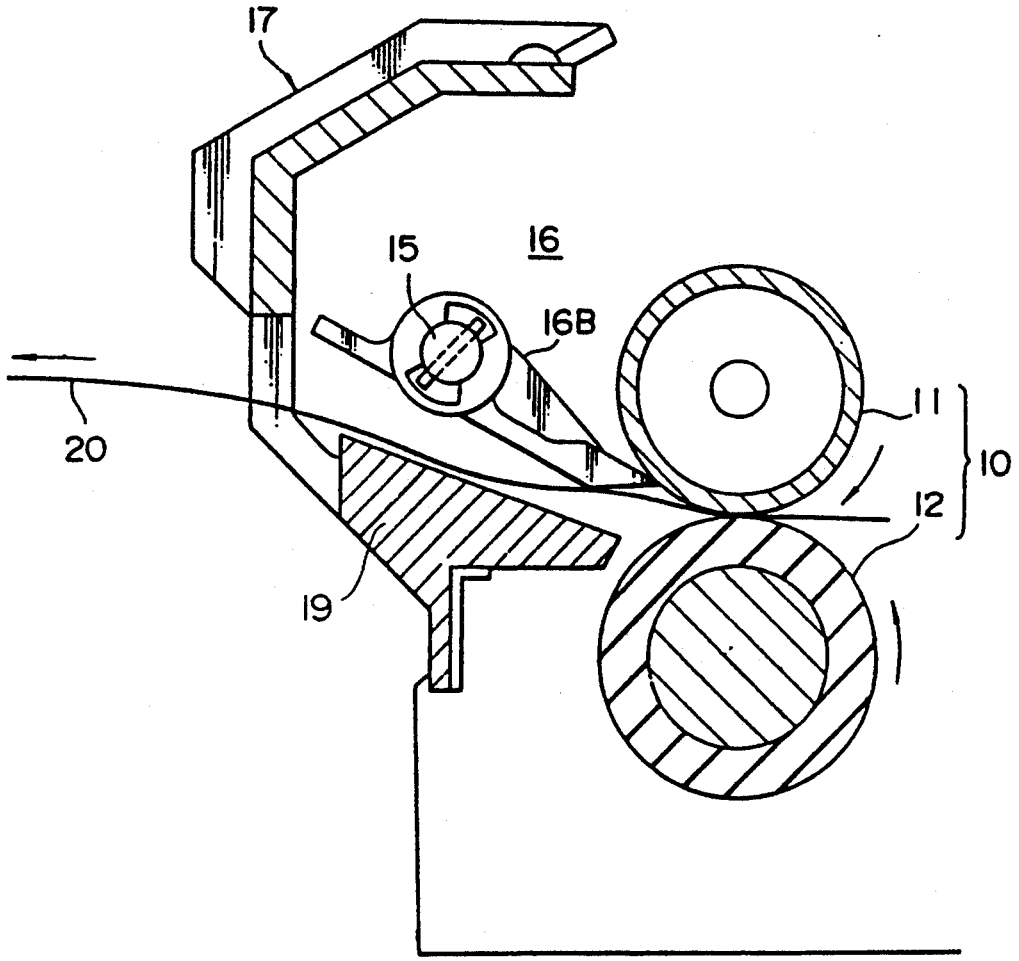
FIG. 6 shows a partial enlarged view of the heat roll fixing unit shown in FIG. 4.
Figure 7:
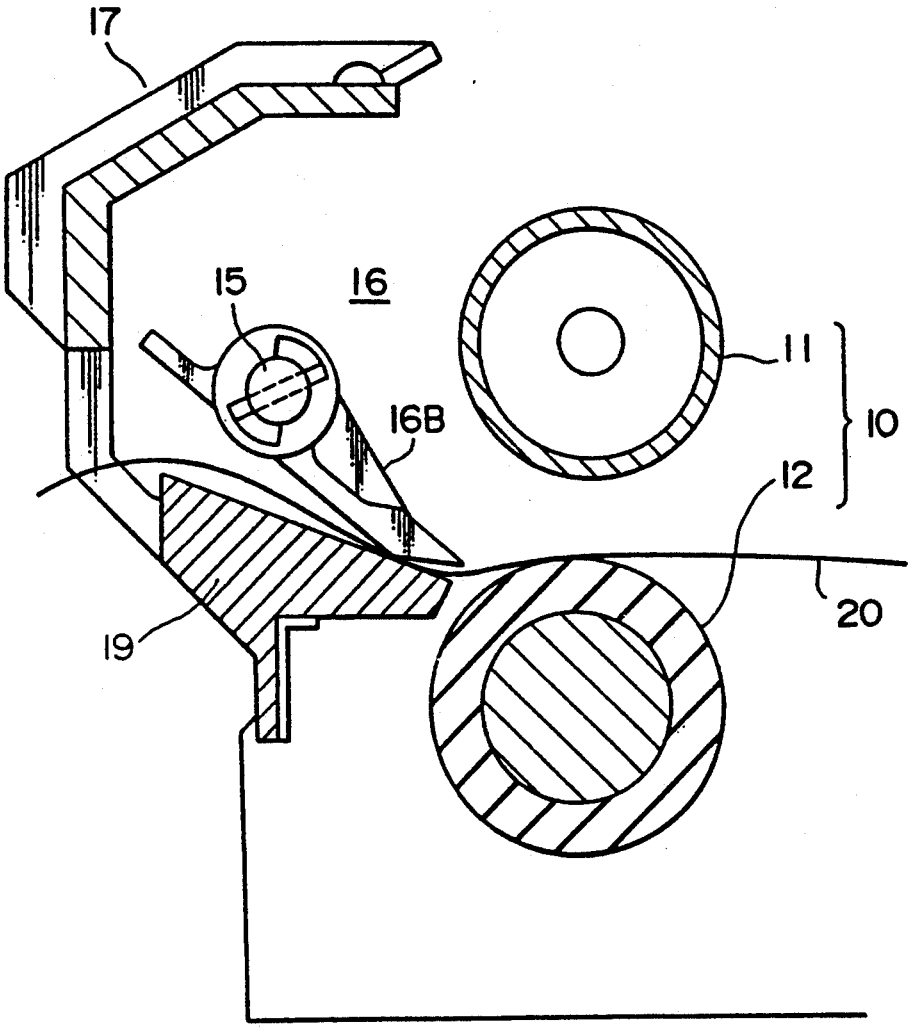
FIG. 7 shows a side view of the heat roll fixing unit in a non-operating state.

As described above, the heat roller 11 is controlled so as to be located at the operating position, shown in FIG. 6, when printing is carried out, and located at the non-operating position, shown in FIG. 7, in accordance with the rotation of the cam 13-2 when printing is not carried out.

Figure 3B:
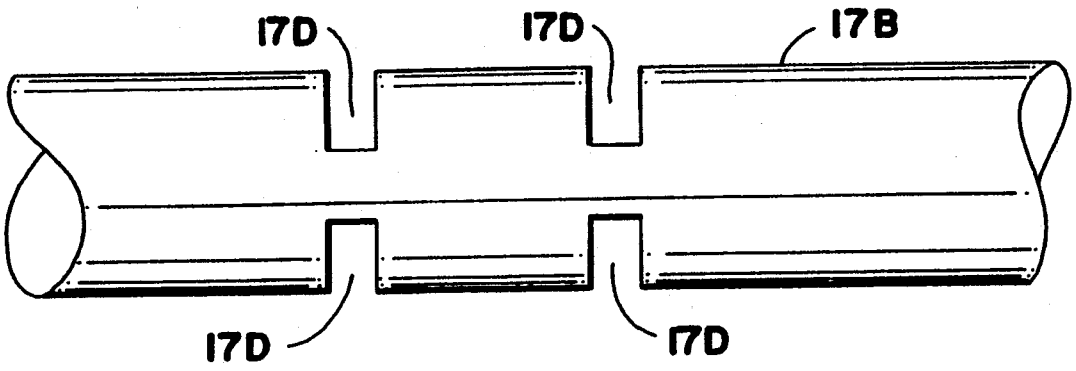
FIG. 3B shows a cutaway portion of the shaft which connects the spacer piece shown in FIG. 3 to the sheet discharge cover.
Figure 3C:
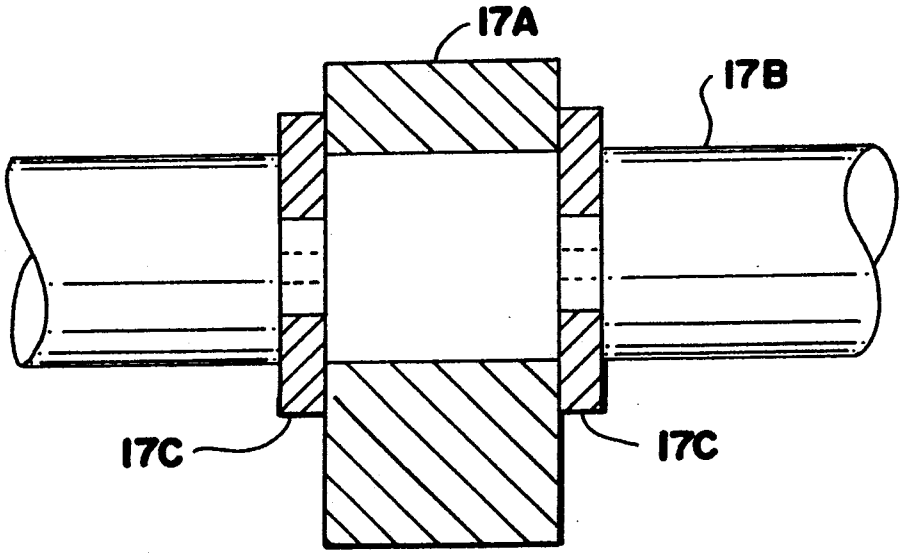
FIG. 3C shows a cross-section of the shaft shown in FIG. 3B, with the spacer piece connected and held in place by retaining rings.

As shown in FIG. 3C, spacer piece 17A is rotatably mounted on shaft 17B. In order to prevent horizontal movement of piece 17A along shaft 17B, E-type retaining rings 17C are mounted in grooves 17D, shown in FIG. 3B.

The shaft 15 is provided at the sheet discharge side of the heat roller 11 in parallel to the heat roller 11 and a jam prevention claw 16 is attached to the shaft 15.

The shaft 15 is supported by a sheet discharge cover 17, which is attached to the lower end of the chassis of the laser beam printer and rocked counterclockwise in the drawing of FIG. 4 in such a manner that the shaft 15 can be turned within a predetermined range and turningly urged clockwise by a spring 15B wound at the one side thereof. Further, an arm 15A is attached to the shaft 15 at a right angle to it at the side thereof opposite to the side where the spring is attached.

Figure 5:
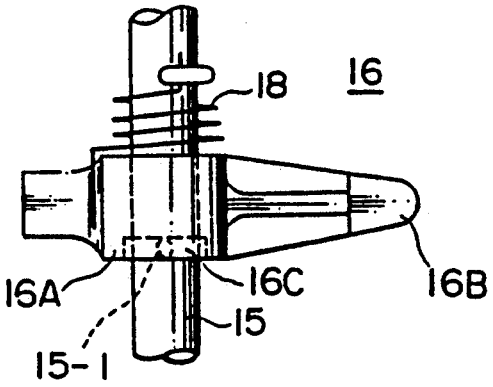
FIG. 5 shows a plane view of the jam prevention piece to be attached to the heat roll fixing unit.

A pair of jam prevention claws 16, 16, whose extreme end is formed to an acute angle, is attached to the shaft 15 in such a manner that the each jam prevention claw 16 is turned within a predetermined angle about shaft 15. As shown in FIG. 5, the jam prevention claw 16 comprises a cylindrical base portion 16A and an claw portion 16B extending therefrom. The shaft 15 is provided with a pin 15-1 to be engaged with a recess 16C formed on an inner surface of the base portion 16A. The pin 15-1 is arranged to be movable in the recess 16C in a radial direction of the shaft 15, and the extreme end 16B of the jam prevention claw 16, i.e., claw portion 16B is urged in the direction approaching the heat roller 11, counterclockwise in the drawing of FIG. 4, by the return force of a spring 18 wound around the shaft 15.

A lower sheet discharge guide 19 is provided along the lower side of the shaft 15, that is, on the paper discharge side of the press roller 12.

In the fixing unit arranged as above, when the lever 13 is rocked by the cam 13-2, the heat roller 11 is located at the operating position to carry out a fixing operation when printing is carried out, and retracted upward by the predetermined distance when printing is not carried out, as described above.

At the operating position, the press roller 12 is pressed against the heat roller 11 by the predetermined pressing force and the heat roller 11 is rotated, so that the continuous-sheet 20 held between the rollers 11, 12 is subject to the fixing operation by being pressed and heated, while the continuous-sheet 20 is fed.

When the heat roller 11 is located at the operating position, the operating portion of the lever 13 is pressed against the arm 15A of the shaft 15 through the spacer piece 17A rockably attached to the sheet discharge cover 17 via mounting shaft 17B to cause the shaft 15 to be turned against the urging force of the spring by a predetermined angle, as shown in FIG. 6. Shaft 17B is attached to cover 17 (not shown) in the same manner that shaft 15 is attached to cover 17, as shown in FIG. 3. The turned shaft causes the extreme end of the jam prevention claws 16, 16 to be held in abutment against the surface of the heat roller 11 and the jam prevention claws 16, 16 to be relatively turned counterclockwise about the shaft 15 against the return force of the spring, so that the jam prevention claws 16, 16 are pressed against the heat roller 11 by a predetermined pressing force produced by the urging force of the spring.

As a result, even if the continuous-sheet 20, which has been subject to the fixing operation, is adhered to the heat roller by the depositing force or the like of the toner, the continuous-sheet 20 can be separated therefrom by the jam prevention claws 16, 16 and discharged.

When the heat roller 11 is retracted upward from the operating position when printing is not carried out, the pressing force applied to the arm 15A from the operating portion 13A of the lever 13 through the spacer piece 17A is released and the shaft 15 is turned clockwise by the urging force of the spring 15B and returned to a free state, as shown in FIG. 7. The turned shaft 15 causes the jam prevention claw 16 to be turned clockwise, and thus the continuous-sheet 20 is held between the lower surface of the jam prevention claws 16, 16 and the lower sheet discharge guide 19. At this time, the extreme end of the jam prevention claws 16, 16 is sufficiently spaced apart from the surface of the heat roller 11, whereby the continuous-sheet 20 can be prevented from continuously abutting against the retracted heat roller 11, even if the continuous-sheet 20 is upwardly bent.

As described above, according to the heat roll fixing unit for an electrophotographic printer using a continuous-sheet of the present invention, even if the continuous-sheet is bent, the sheet can be prevented from continuously abutting against the heat roller when printing is not carried out.

Further, since the extreme end of the jam prevention claw is held in abutment against the heat roller to accelerate the continuous-sheet to be separated from the heat roller when a fixing operation is carried out, the separation of the continuous-sheet is accelerated to prevent the continuous-sheet from being poorly fed. Further, it becomes possible to prevent the continuous-sheet from being wound around the heat roller by heat when the continuous-sheet is newly set to the electrophotographic printer.

The present disclosure relates to subject matter contained in Japanese patent application No. HEI 02-054164 (filed on Mar. 6, 1990) and the Japanese patent application No. HEI 3-112662 (filed on Feb. 21, 1991) which are expressly incorporated herein by reference in their entireties.

What is claimed is:

1. A heat roll fixing unit, adapted to be positioned in a printer employing an electrophotographic system for forming an image on a continuous-sheet to be fed in said printer, said heat roll fixing unit comprising:

a pair of rollers arranged to be brought into and out of contact with each other for pressurizing said continuous-sheet to fix the image formed thereon, one of said pair of rollers being a heat roller to be heated by a predetermined heating member; and a sheet separation mechanism, located at the downstream side of said pair of rollers, for separating said continuous-sheet from said heat roller, said sheet separation mechanism comprising a separation member and means mounting said separation member for movement between a first position in which said separation member is in contact with said heat roller when said pair of rollers are in contact with each other and a second position in which said separation member is out of contact with said heat roller and in contact with said continuous-sheet when said pair of rollers are out of contact with each other.

2. The heat roll fixing unit according to claim 1, wherein said sheet separation mechanism comprises a rocking member arranged to be rocked when said pair of rollers are brought out of contact with each other and a shaft member rotatable with the rocking operation of said rocking member, said shaft member being located along the width direction of said continuous-sheet and having a pair of sheet separation claws arranged to be separated from a circumferential surface of said heat roller in accordance with the rotation of said shaft member, whereby said continuous-sheet fed through said pair of rollers and in contact with said heat roller is separated from said heat roller by said pair of sheet separation claws.

3. The heat roll fixing unit according to claim 1, wherein said predetermined heating member comprises a halogen lamp.

4. The heat roll fixing unit according to claim 2, which further comprises a rotating member for rotating said shaft member so that said pair of sheet separation claws are contacted with said circumferential surface of said heat roller when said pair of rollers are brought into contact with each other.

5. The heat roll fixing unit according to claim 4, wherein said rotating member comprises a torsion spring provided around said shaft member.

6. The heat roll fixing unit of claim 1, said separating member comprising means for separating said continuous sheet from said roller when said rollers are in contact with each other.

7. The heat roll fixing unit according to claim 1, further comprising means for supporting said heat roller and means for biasing said supporting means so that a predetermined pressurizing force is provided between said pair of rollers when said rollers are brought into contact with one another.

8. The heat roll fixing unit according to claim 7, wherein said supporting means comprises a heat roll holder in which said heat roller is accommodated, a lever that is pivotally mounted in said printer and which supports said heat roll holder, and means for pivoting said lever so that said heat roller is brought into and out of contact with the other roller of said pair of rollers, and wherein said biasing means comprises a spring interposed between said heat roller holder and said lever.

9. The heat roll fixing unit according to claim 8, further comprising means for moving said separation member in response to the pivotal movement of said lever.

10. The heat roll fixing unit according to claim 1, further comprising a sheet discharge guide for guiding said continuous-sheet fed through said pair of rollers, said continuous-sheet being held between said separation member and said sheet discharge guide when said rollers are out of contact from each other.

11. A heat roll fixing unit, adapted to be positioned in a printer employing an electrophotographic system for forming an image on a continuous-sheet to be fed in said printer, said heat roll fixing unit comprising:

a pair of rollers arranged to be brought into and out of contact with each other for pressurizing said continuous-sheet to fix the image formed thereon, one of said pair of rollers being a heat roller to be heated to a predetermined temperature;

a pair of sheet separating claws located at the downstream side of said pair of rollers and arranged to be separated from a circumferential surface of said heat roller when said pair of rollers are brought out of contact from each other, said pair of separating claws arranged to be in contact with a circumferential surface of said heat roller when said pair of rollers are in contact with each other and arranged to be in contact with said continuous-sheet when said pair of rollers are out of contact from each other, so that said continuous-sheet fed through said pair of rollers is separated from said heat roller by said pair of sheet separating claws.

12. The heat roll fixing unit according to claim 11, further comprising means for supporting said heat roller and means for biasing said supporting means so that a predetermined pressurizing force is provided between said pair of rollers when said rollers are brought into contact with one another.

13. The heat roll fixing unit according to claim 12, wherein said supporting means comprises a heat roll holder in which said heat roller is accommodated, a lever that is pivotally mounted in said printer and which supports said heat roll holder, and means for pivoting said lever so that said heat roller is brought into and out of contact with the other roller of said pair of rollers, and wherein said biasing means comprises a spring interposed between said heat roller holder and said lever.

14. The heat roll fixing unit according to claim 13, further comprising means for moving said separating claws in response to the pivotal movement of said lever.

15. The heat roll fixing unit according to claim 11, further comprising a sheet discharge guide for guiding said continuous-sheet fed through said pair of rollers, said continuous-sheet being held between said separating claws and said sheet discharge guide when said rollers are out of contact from each other.

16. A heat roll fixing unit for an image forming apparatus forming an image on a continuous-sheet, said heat roll fixing unit comprising:

a pair of rollers, arranged to be brought into and out of pressure contact with one another, for pressing a continuous-sheet to fix the image formed thereon, one of said pair of rollers being a heat roller;

sheet separating means for separating said continuous-sheet from said heat roller, said sheet separating means being operable when pair of rollers are brought out of pressure contact with one another; and said sheet separating means comprising at least one separation member and means mounting said at least one separation member for movement between a first position in which said separation member is in contact with said heat roller when said pair of rollers are in contact with each other and a second position in which said separation member is out of contact with said heat roller and in contact with said continuous-sheet when said pair of rollers are out of contact with each other.

17. The heat roll fixing unit according to claim 16, wherein said sheet separating means is located at a downstream side of said pair of rollers.

18. The heat roll fixing unit according to claim 16, wherein said sheet separating means comprises a claw member rotatably supported by a shaft member, said shaft member arranged to be rotated when said pair of rollers are brought out of pressure contact with one another, whereby said claw member separates the continuous-sheet from said heat roller, in accordance with the rotation of said shaft member, when said pair of rollers are brought out of pressure contact with one another.

19. The heat roll fixing unit according to claim 18, wherein said sheet separating means further comprises a rocking member rockably arranged to rotate said shaft member when said pair of rollers are brought out of pressure contact with one another.

20. The heat roll fixing unit according to claim 19, wherein said rocking member comprises a lever rockably mounted to the chassis of said image forming apparatus by a pin, said lever being downwardly biased by a spring and rockably driven by means for camming.

21. The heat roll fixing unit according to claim 18, wherein said sheet separating means further comprises a rotating member for rotating said shaft member, whereby said claw member contacts a circumferential surface of said heat roller, when said pair of rollers are brought into pressure contact with one another, and prevents said continuous-sheet from adhering to and being rolled around said heat roller.

22. The heat roll fixing unit according to claim 21, wherein said rotating member comprises a torsion spring provided around said shaft member, said heat roll fixing unit further comprises limiting means for limiting the rotation of said claw member to a predetermined angle about said shaft.

23. The heat roll fixing unit according to claim 16, wherein said heat roller is heated by a halogen lamp.

24. The heat roll fixing unit according to claim 16, further comprising means for supporting said heat roller and means for biasing said supporting means so that a predetermined pressurizing force is provided between said pair of rollers when said rollers are brought into contact with one another.

25. The heat roll fixing unit according to claim 24, wherein said supporting means comprises a heat roll holder in which said heat roller is accommodated, a lever that is pivotally mounted in said image forming apparatus and which supports said heat roll holder, and means for pivoting said lever so that said heat roller is brought into and out of contact with the other roller of said pair of rollers, and wherein said biasing means comprises a spring interposed between said heat roller holder and said lever.

26. The heat roll fixing unit according to claim 25, further comprising means for moving said separation member in response to the pivotal movement of said lever.

27. The heat roll fixing unit according to claim 16, further comprising a sheet discharge guide for guiding said continuous-sheet fed through said pair of rollers, said continuous-sheet being held between said separation member and said sheet discharge guide when said rollers are out of contact from each other.

28. A heat roll fixing unit for an image forming apparatus forming an image on a continuous-sheet, said heat roll fixing unit comprising:

a pair of rollers for fixing, to a continuous-sheet, an image formed thereon, said rollers arranged to be brought into and out of contact with one another; and sheet separating means for separating the continuous-sheet from one of said rollers when said pair of rollers are brought out of contact with one another;

said sheet separating means comprising a sheet separating member located at a downstream side of said pair of rollers, and means mounting said sheet separating member for movement between a first position in which said sheet separating member is in contact with one of said rollers when said pair of rollers are in contact with each other and a second position in which said sheet separating member is separated from said one of said rollers and in contact with said continuous-sheet when said pair of rollers are out of contact with each other.

29. The heat roll fixing unit according to claim 28, wherein said sheet separating means comprises means for preventing said continuous-sheet from adhering to and being wrapped around one of said rollers when said pair of rollers are in contact with one another.

30. The heat roll fixing unit of claim 28, said one of said pair of rollers comprising a heat roller.

31. The heat roll fixing unit according to claim 28, wherein said pair of rollers includes a heat roller, and said heat roll fixing unit further comprises means for supporting said heat roller and means for biasing said supporting means so that a predetermined pressurizing force is provided between said pair of rollers when said rollers are brought into contact with one another.

32. The heat roll fixing unit according to claim 31, wherein said supporting means comprises a heat roll holder in which said heat roller is accommodated, a lever that is pivotally mounted in said image forming apparatus and which supports said heat roll holder, and means for pivoting said lever so that said heat roller is brought into and out of contact with the other roller of said pair of rollers, and wherein said biasing means comprises a spring interposed between said heat roller holder and said lever.

33. The heat roll fixing unit according to claim 32, further comprising means for moving said sheet separating member in response to the pivotal movement of said lever.

34. The heat roll fixing unit according to claim 28, further comprising a sheet discharge guide for guiding said continuous-sheet fed through said pair of rollers, said continuous-sheet being held between said sheet separating member and said sheet discharge guide when said rollers are out of contact from each other.

35. A heat roll fixing unit for an image forming apparatus forming an image on a continuous-sheet, said heat roll fixing unit comprising:

a pair of rollers for fixing, to a continuous-sheet, an image formed thereon, said pair of rollers arranged to be brought into and out of contact with one another, said pair of rollers including a heat roller; and sheet separating means for separating the continuous-sheet from one of said rollers when said pair of rollers are in contact with one another, said sheet separating means comprising sheet separating members mounted for movement with respect to said one of said rollers in accordance with the movement of said rollers between an in contact position and an out of contact position, so that said separating members are in contact with a surface of said one of said rollers when said rollers are in contact with each other and said separating members are in contact with said continuous-sheet when said rollers are out of contact from each other.

36. The heat roll fixing unit according to claim 35, further comprising means for supporting said heat roller and means for biasing said supporting means so that a predetermined pressurizing force is provided between said pair of rollers when said rollers are brought into contact with one another.

37. The heat roll fixing unit according to claim 36, wherein said supporting means comprises a heat roll holder in which said heat roller is accommodated, a lever that is pivotally mounted in said image forming apparatus and which supports said heat roll holder, and means for pivoting said lever so that said heat roller is brought into and out of contact with the other roller of said pair of rollers, and wherein said biasing means comprises a spring interposed between said heat roller holder and said lever.

38. The heat roll fixing unit according to claim 37, further comprising means for moving said sheet separating members in response to the pivotal movement of said lever.

39. The heat roll fixing unit according to claim 35, further comprising a sheet discharge guide for guiding said continuous-sheet fed through said pair of rollers, said continuous-sheet being held between said sheet separating members and said sheet discharge guide when said rollers are out of contact from each other.

* * * * *